US008479315B2

(12) United States Patent
Kelling

(10) Patent No.: US 8,479,315 B2
(45) Date of Patent: Jul. 9, 2013

(54) CONVERTIBLE GARMENT AND CONTAINER

(75) Inventor: Sven Kelling, Cambridgeshire (GB)

(73) Assignee: Ruckjack Limited, Hertfordshire (GB)

( * ) Notice: Subject to any disclaimer, the term of this patent is extended or adjusted under 35 U.S.C. 154(b) by 800 days.

(21) Appl. No.: 12/451,258

(22) PCT Filed: May 1, 2008

(86) PCT No.: PCT/GB2008/050317

§ 371 (c)(1),
(2), (4) Date: Nov. 3, 2009

(87) PCT Pub. No.: WO2008/135782

PCT Pub. Date: Nov. 13, 2008

(65) Prior Publication Data

US 2010/0127025 A1 May 27, 2010

(30) Foreign Application Priority Data

May 4, 2007 (GB) ..... 0708607.7

(51) Int. Cl.
*A41D 1/02* (2006.01)

(52) U.S. Cl.
USPC ..... 2/94; 2/69

(58) Field of Classification Search
USPC ..... 2/69, 126, 108, 94, 69.5, 84, 85, 2/88, 89
See application file for complete search history.

(56) References Cited

U.S. PATENT DOCUMENTS

| | | | | |
|---|---|---|---|---|
| 2,959,789 | A | 11/1960 | Mills et al. | |
| 4,057,854 | A | 11/1977 | Phelps, Sr. | |
| 4,347,629 | A * | 9/1982 | Itoi | 2/108 |
| 4,502,154 | A * | 3/1985 | Itoi | 2/108 |
| 5,996,121 | A | 12/1999 | Harris | |
| 6,405,377 | B1 * | 6/2002 | Davis | 2/94 |
| 6,971,566 | B1 | 12/2005 | Sartena | |

FOREIGN PATENT DOCUMENTS

| | | |
|---|---|---|
| EP | 0 269 578 | 6/1988 |
| FR | 2 673 083 | 8/1992 |

OTHER PUBLICATIONS

International Search Report for PCT/GB2008/050317 mailed Oct. 20, 2008.
UK Combined Search and First Examination Report dated Aug. 6, 2008 for GB 0807958.4.
UK Second Examination Report dated Dec. 4, 2008 for GB 0807958.4.

* cited by examiner

*Primary Examiner* — Tejash Patel
(74) *Attorney, Agent, or Firm* — Nixon & Vanderhye P.C.

(57) ABSTRACT

A system (20) having the form of a garment (22), such as a jacket or pullover top, which can be transformed into one of a number of different fully closable containers (24), such as a rucksack, bag, or daypack, or vice-versa and a method for performing the transformation. Closure of the neck aperture (15) is operated by actuating a first closure means (1) extending from a common point (14) below the neck on the back of the body (R) of the garment, over the shoulders on either side of the neck aperture down the front (F) of said body.

20 Claims, 6 Drawing Sheets

CONVERTIBLE GARMENT AND CONTAINER

This application is the U.S. national phase of International Application No. PCT/GB2008/050317 filed 1 May 2008 which designated the U.S. and claims priority to British Patent Application No. 0708607.7 filed 4 May 2007, the entire contents of each of which are hereby incorporated by reference.

This invention concerns a system which can be transformed from a garment, such as a jacket or pullover top, to one of a number of different fully closable containers, such as a rucksack, bag, or daypack, or vice-versa.

Prior art arrangements which can be transformed between a garment mode and a container mode and vice versa comprise elements which are typically in use in only one of these modes. Conversely in either mode some elements of the arrangement are not in use at all and are redundant for that particular mode. An example of such a jacket is disclosed, for example, by EP0269578. In such arrangements a jacket may be transformed into a rucksack: the arrangement comprises straps (or tapes) attached to the inner side of the jacket which have no use while the arrangement is being worn as a jacket. The straps are exposed by turning the jacket inside out. In this way, the straps are used exclusively in the rucksack mode, being redundant in the jacket mode.

When the arrangement is in the jacket mode the unused straps are stored on the inner side of the back of the jacket. The straps thus rest against the wearer's back during the wearing of the jacket which can be uncomfortable and inconvenient. There is a further inconvenience when the jacket is put on or taken off as the straps may hinder insertion or removal of the wearer's hands and arms into or out of the sleeves.

Conversely, the sleeves of the jacket are redundant in the rucksack mode, being merely stowed within the body of the container. In this mode the sleeves are inconveniently placed within the rucksack, taking up valuable space within the container volume and, being unstowed, also obscuring objects or items contained within the rucksack, thereby reducing accessibility and the overall functionality of the arrangement in the container mode.

Other prior art arrangements generally involve multi-step operations to effect this conversion which may be cumbersome and non-intuitive and do not offer sufficient modularity and flexibility to the user. An example of such a jacket is disclosed, for example, by U.S. Pat. No. 4,057,854.

In such arrangements a garment having pairs of grommets located on the sleeve cuffs and around the waist and the neck may be converted into a rucksack. The conversion is effected by threading a drawstring through the grommets located on the cuffs and the waist. Pulling the string ends has the effect of securing the sleeves against the waist band and closing the waist aperture therefore providing simultaneously the straps and the base of the backpack arrangement, respectively. This conversion procedure may be excessively burdensome and time consuming as the user is obliged to unthread the drawstring from around the waist of the garment and then thread the string back again through the plurality of grommets located around the waist and on the cuffs and may therefore require several minutes to complete. The base of the rucksack thereby obtained is constituted by a number of grommets grouped together by a drawstring, the integrity thereof relying mainly if not exclusively on the tearing strength of the fabric used in the manufacture of the garment. As a consequence, the weight-carrying capacity of such rucksack is significantly limited and is unlikely to support repetitive loading of relatively heavy items. Another potential disadvantage of this arrangement is the lack of modularity offered by the rucksack configuration. Indeed, only a single size of rucksack can be obtained therefore limiting the versatility thereof.

U.S. Pat. No. 5,996,121 discloses a coat convertible into a bag by folding the coat transversely and maintaining the folded position thereof using pairs of fasteners and wherein the sleeves ends are fastened to one another thereby forming a shoulder strap. The folding step requires the user to follow a predefined folding pattern and can only realistically be achieved by laying out the garment on a flat surface and follow the multiple step of the folding process. The bag thereby obtained relies only on pre-existing pockets of the coat arrangement for storage space therefore significantly reducing the carrying capacity of the bag. This arrangement only provides a mono-strap bag configuration when higher load carrying requirements would benefit from a two-strap configuration allowing better load repartition across the back of the carrier.

It is an object of the present invention to reduce and possibly overcome the shortcomings of prior art arrangements.

SUMMARY OF THE INVENTION

The object of the present invention is to provide a single system, arrangement or device which can be used sequentially as a garment or container, such that if the container has fulfilled its main function, of helping to carry objects from an origin to a destination, it can provided further functionality at the destination as a garment to provide warmth and protection. Alternatively, after the garment has fulfilled its main function of protection during a journey, it can be converted into a container to carry objects. Furthermore, it is the object to provide a system that in container mode can be carried in various ways and is adjustable to different sizes such that it offers the optimal solution for any transport requirement.

A further object of this invention is to provide a conversion system from one mode to another that is extremely easy and can be carried out quickly and with no user instructions.

In a first embodiment of the invention there is a system, for use in two different modes, having the form of an upper body garment comprising a body for wearing, in a garment mode, on the torso of a wearer, having a central axis, apertures corresponding to the waist and the neck of a wearer, two sleeves, at least one first closure means and wherein the at least one first closure means comprises a fastening means comprising two elongate interlocking fastening elements for fastening along their length which, in the garment mode, when the fastening means is open, extend from a first common point below the neck on the back of the body, over the shoulders of the body either side of the neck aperture and down the front of the body, and which, in the container mode, when the fastening means is closed, interlock continuously from the first common point to a second common point located below the neck on the front of the body, thereby closing the neck aperture.

Preferably, the first closure means extends from the first common point to a second point located at the waist, thereby to allow the garment to be fully openable at the front thereof in the style of a jacket having a full length zip or fastener.

In a preferred embodiment the first closure means may be a zip fastener or fasteners, whereby the or each zip comprises a two zip elements each consisting of zip teeth which, when the zip is closed, are designed to interlock with corresponding teeth on the other zip element. However, any reference to a zip fastener is merely exemplary and the invention is not limited to zip fasteners, as any form of elongate means of fastening comprising two elongate members which interlock with each other is envisaged within the invention. Further examples include Velcro bands, series of buttons, press studs or other fasteners, as well as non-zip slide mechanisms comprising two elongate interlockable strips closed by a slider.

During the conversion from garment to container mode the system is not turned inside out as in prior art examples. As the system does not have to be reversed, the liner stays inside, dry and protected.

The system may be turned upside down during transformation to create large volume and fully closable container/bag, i.e., it is a fully functional and safe container. This mode is described as the "inverted mode" later herein.

In the container mode the system is more robust than prior art examples due to the use of a fastening means for closing the neck opening of the garment. i.e., the container is suitable for carrying heavy and large loads.

In another arrangement, the present invention consists of a jacket with a central opening extending from the neck to the waist on the front of the body, which is thereby divided into two portions, wherein the two elongate interlocking fastening elements of the fastening means, when the fastening means is closed, extend generally down the front of the jacket and along or parallel to the central axis of the jacket.

The two elongate interlocking fastening elements, when the fastening means is open, may extend down the front of the body of the jacket in spaced apart relationship, thereby forming at least one central panel between the edge of the central opening and the fastening element in each portion of the front of the body, wherein, when the fastening means is closed, the central panel is stored within the body of the system.

Advantageously, the two interlocking fastening elements extend parallel with the central axis.

Alternatively, the two interlocking fastening elements extend along a line non-parallel with the central axis.

Ideally, the jacket comprises multiple first closure means such as the corresponding interlocking fastening elements are positioned at different distances from the central opening, thereby forming central panels of different widths wherein, when the fastening means is closed, the body of the jacket comprises different volumes. The size of the system in container mode can thereby be adjusted: this will be described in detail later in the description.

It would be appreciated that according to the type of garment embodying the present invention, i.e. jackets, T-shirt, pull-over or the like, the central opening may extend from the neck aperture down the waist of the garment as described above for a jacket but may also extend from the neck aperture to an intermediate location between the neck and the waist. In the latter arrangement, the at least one first closure means may extend from the common point below the neck aperture down the waist of the body in the same manner as described above or may extend from the same common point down an intermediate location between the neck and the waist.

In another embodiment, the central opening includes a zip fastener which also forms the first closure means. In this arrangement, a single fastening means is required to actuate the closure of the central opening when the invention is worn, in the garment mode, on the back of the wearer and to effect the conversion from garment to container by operating the zip fastener upwardly from a common point at the waist on the front of the body to the common point located below the neck on the back thereof, thereby closing the neck aperture.

The present invention further provides at least one second closure means for closing, in a container mode, a second aperture.

In a preferred embodiment the second closure means is a drawstring fastening means. However, it will be appreciated that other suitable means for achieving the same results may be contemplated and includes, but are not limited to, zip fastening means, roll top closure means, Velcro fastening means, slide fastening means and stud fastening means.

The present invention further comprises a primary attachment means on a first sleeve and a secondary attachment means distant from the primary attachment means, wherein the primary attachment means may be attached, in the container mode, to the secondary attachment means, thereby converting the first sleeve into a strap forming a loop.

Preferably, the primary attachment means is located at the end of the first sleeve.

The primary attachment means may also be located anywhere on the first sleeve between the cuff and the armpit and preferably at the end thereof. A plurality of primary attachment means may also be provided at different location on the sleeve. This has the advantage of allowing the user to further control the size of the strap loop by selecting one of the provided primary attachment means and connecting it to one of the secondary attachment means thereby forming a strap having the desired loop size, i.e. relatively small or large according to the user's need.

The form of the loop created in the single strap configurations also depends on the location of the secondary attachment means. If the secondary attachment means is located on the body of the garment, attachment of the primary attachment means to the secondary attachment means will transform the sleeve into a single strap forming a loop between the proximal end of the sleeve and its distal end where the primary and secondary attachment means are joined. The secondary attachment means may be on same sleeve of the garment as the first attachment means, but at some point remote from the first attachment means, such that attachment of the first and second attachment means forms a loop entirely within the same sleeve, attached to the body only at the proximal end: a loop thus generated may be relatively small, depending on the proximity of the secondary attachment means to the primary attachment means. The secondary attachment means may also be located on the sleeve not comprising the primary attachment means, whereby attachment of the primary and secondary attachment means would join the ends of the two sleeves together, thereby forming a single strap.

Preferably, a further primary attachment means on the second sleeve and a further secondary attachment means located at a second location are provided. A second strap is formed by attaching the further primary attachment means to the further secondary attachment means, thereby converting the second sleeve into a strap forming a loop.

Advantageously, the secondary attachment means is located at the end of the second sleeve for the reasons highlighted above.

The object of the present invention is thereby achieved by virtue of the fact that the system in the garment mode comprises, in combination, a first closure means that, in a single and easy step, closes the neck opening and, optionally, sleeves that can be attached with attachment means, such as fasteners, to the main body of the garment thereby transforming them into two separate carrying straps for a rucksack like container configuration, sleeve ends that can be attached to each other with fasteners thereby transforming the sleeves into a single strap for the configuration in which the container is carried by one shoulder strap, a second closure means at the lower hem that allow closing the system in container configuration and adjust its volume.

In this manner a container with two straps of the rucksack type or a container with a single strap may be generated in a configuration resembling a hip bag or shoulder bag, i.e. the system can be converted into the container configuration best suited for current transport requirements.

The system therefore serves equally well as fully functional rucksack, large shoulder bag, small shoulder bag and garment. This multifunctionality reduces the amount of luggage to be carried on small trips and holidays.

In the container mode the system is easy to load and unload. If converted from a jacket in the garment mode the central opening provides a particularly convenient access to the interior of the system in the container mode: by opening the main slide fastener, the whole volume of the container is accessible.

The sleeves of the garment are turned into carrying straps, i.e., the need for extra straps, as used in prior art designs, is removed. Using dual functionality sleeves/straps makes extra straps redundant and removes the problem of having to store, hide, or incorporate carrying straps into the design of the garment.

In another embodiment the closure means closes the neck aperture and the system is inverted: by turning the system upside down the waist aperture of the garment is transformed into the main top opening of the container and the closed neck aperture becomes the base of the container.

Preferably, the present invention further comprises reinforcing means attached to or integrated into the fabric of the sleeve and extending from the attachment means at the sleeve ends along the sleeves to the body.

Advantageously, the reinforcing means is a reinforcing webbing extending in a fan away from the attachment means at the sleeve ends.

As will be described in detail later, the system in the container mode can be adjusted in size by rolling the top down, i.e., the same system can be used as a large container, such as a 45 liter rucksack for large items, and as smaller container, such as a daypack. This may be achieved by the provision of at least two side attachment positioned in the waist region of the body of the system which are attachable to each other.

Advantageously, the system is designed such that the same pockets can be accessed before and after the transformation between garment and container i.e. there is no need to remove objects such as phone, wallet, keys when transforming the system from garment to container or vice versa.

The system comprises a pocket in the garment configuration that is large enough to carry mid size items, such as books, towels etc., that used to be in the container before the transformation to a garment, i.e., a transport function is maintained even after transformation into a garment.

The openings for the midsize storage pockets of the system in garment configuration are designed such that they serve also as air vents.

The present invention relates to a system which can be transformed from a garment, such as a jacket or pull over top, to a number of different closable containers, such as a rucksack, large shoulder bag, or small daypack shoulder bag and vice-versa.

By virtue of these characteristics, the system according to the invention can be used for small trips and holidays. The system can be used for, but is not limited to, the examples described below.

In kitesports (snowkiting, kitebuggying, powerkiting, kitesurfing) the system can be used in the container configuration to carry the kite to a launching spot. After removing the kite, instead of having an empty rucksack lying on the beach, the system can be transformed into a garment and worn for further protection during the kitesport activity or during breaks, for example when coming off the water for a rest, for extra warmth and protection while inactive.

For camping trips the system can be used to carry a small tend, sleeping bag and other camping equipment during the hike to the campground. After setting up the camp, the system can be converted into a garment to provide an additional clothing shell to protect from the weather for example during cold evenings.

When riding a motorbike, even in a warm climate, an extra jacket is worn to protect from the wind-chill. After the ride, without the wind chill, a motorbike rider typically takes the jacket off to carry it with his hands or over the arm together with the crash helmet, gloves etc. The system presented in this invention can be transformed into a rucksack- or shoulder bag-like container after the motorbike ride and serve to transport the helmet, gloves etc. in a very convenient manner.

On short trips the system presented here can be used as main transport container for everything required on the trip. At the destination, such as a hotel, the container will be emptied and the system can be converted into either a small day pack that can be extended when going shopping or can be used as a jacket if the weather turns windy, rainy or cold. Thereby the amount of luggage to be carried on short trips is reduced by removing the need to pack an additional small bag and an extra jacket into the travelling luggage.

DISCUSSION OF DRAWINGS

Further advantages and characteristics of the system according to the invention will become clear from the detailed description which follows, provided purely by way of non-limiting example, with reference to the appended drawings, in which.

DETAILED DESCRIPTION OF THE PRESENT INVENTION

Figure 1:
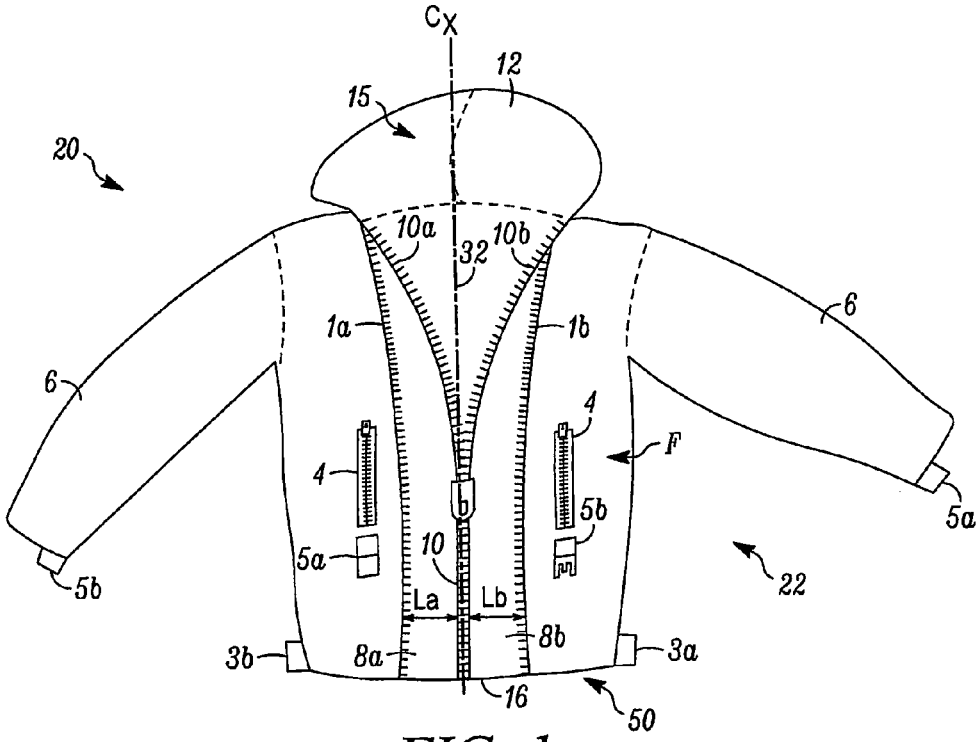
FIG. 1 is a front view of the system in garment configuration, designed as a jacket with hood.
Figure 2:
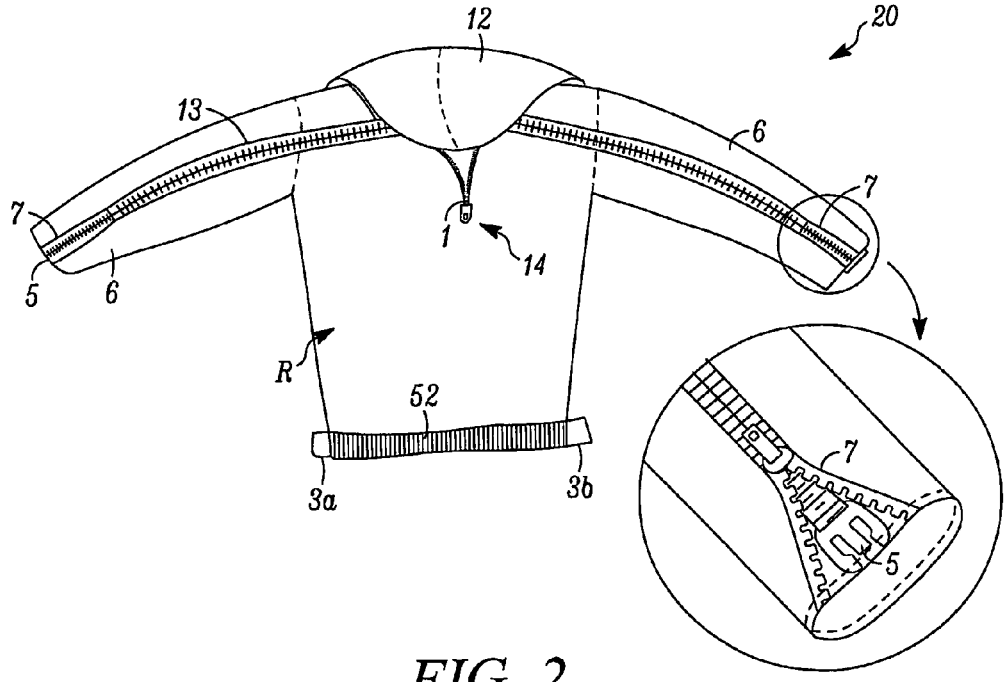
FIG. 2 is a rear view of the system in garment configuration, designed as a jacket with hood.
Figure 3:
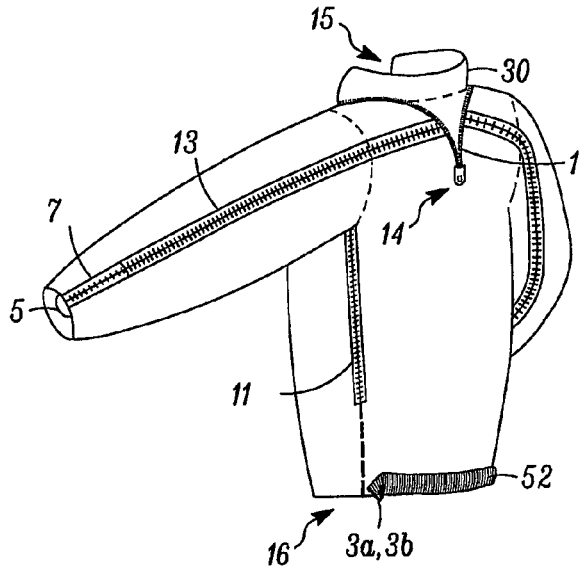
FIG. 3 is a side view of the system in garment configuration, designed as a top with straight collar, showing the side slide fastener.

The container-garment system 20 is shown in the garment mode 22 in FIGS. 1, 2 and 3 and in the container mode 24 in FIGS. 4-12. It is made from a suitable durable, but robust, fabric: the material is preferably waterproof, but lightweight and has thermal insulation properties suitable for retaining the wearer's body warmth in the garment mode. The garment can be designed like a jacket, a T-shirt, windcheater, kagool or any other upper body garment. The garment can have any type of collar. A straight collar 30 is shown in FIG. 3 and a collar with hood 12 is shown in FIGS. 1 and 2. As a garment the system may or may not have a central opening 10, which could run the whole length of the garment, as shown in FIG. 1 where the garment is a jacket, or only along a part of the length to widen the neck opening but terminating part way down the front of the garment.

In one embodiment of the invention the closure elements 1*a*, 1*b* of the first closure means 1 extend upwards from a point 14 on the reverse side of the garment between the shoulder blades and over the shoulders and either side of the neck aperture 15 toward the front of the garment (see FIGS. 2 and 3). From the perspective of the system in garment mode, the first closure means 1 extends down the front side of the garment. For a non-jacket or kagool type of garment it may extend to a point 32 corresponding to the chest of the wearer, or, if of the jacket-type, it may extend to the waistline 16 (see FIGS. 1 and 4). Closing the first closure means 1 will close the neck aperture 15 and store the collar and hood 12.

Where a jacket-type garment is employed, the central opening comprises a fastening means, preferably a zip fastener comprising two interlocking elongate fastening elements 10*a*, 10*b*, in which the neck closure means 1*c*, 1*d* may also form the central opening closure means 10*a*, 10*b*, serving also as closure means for the central opening 10 of the jacket, the closure means elements extending continuously from the point 14 on the reverse side R, either side of the neck aperture and down the central axis of the front F of the garment. Alternatively, in another embodiment of the invention, the first closure means 1*a*, 1*b* is separate from the central opening closure means 10*a*, 10*b*: the two elements 1*a*, 1*b* of the first closure means instead extending either side of the neck aperture 15 and down the front of the garment forming a central panel 8 having two portions 8*a*, 8*b* which extends between the two closure elements 1*a*, 1*b* and includes the central axis Cx. In this embodiment of the invention, when the system is in container mode, i.e. when the neck closure means 1 is closed, the central panel 8 may be stowed inside the body of the container.

It will be appreciated that the two closure elements 1*a*, 1*b* of the first closure means 1 may extend down the jacket front at fixed distances La, Lb from the central axis Cx of the jacket front i.e. extending parallel to the central axis but not parallel with it. Alternatively, the closure elements 1*a*, 1*b* may be non-parallel with the central axis e.g. converging with the central axis at the waist of the body.

Figure 11:
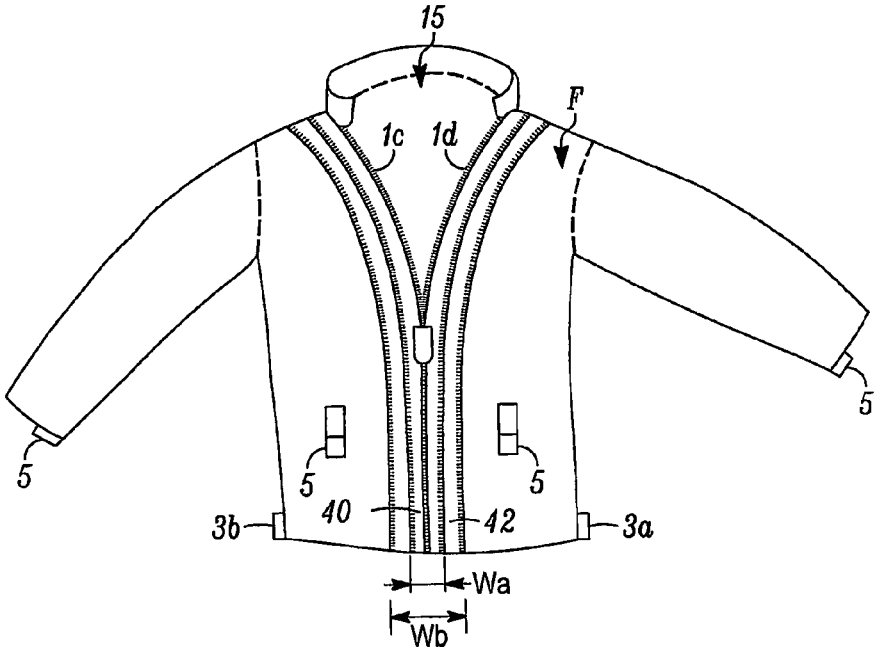
FIG. 11 is a front view of the system with multiple neck closure means allowing transformation into container of different sizes.
Figure 12:
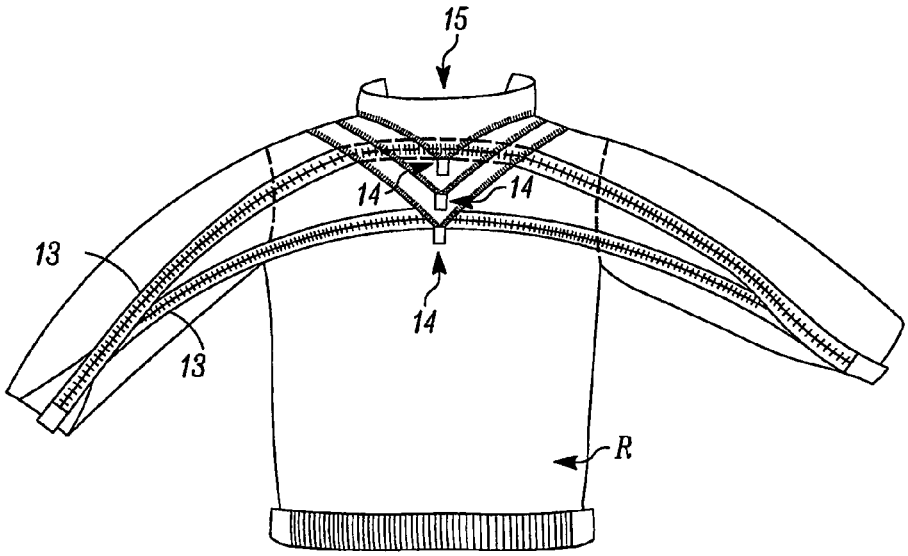
FIG. 12 is a rear view of the system with multiple neck closure means and multiple supporting strips for improved load bearing.

There may also be a plurality of first closure means, with closure members extending from points 14, close to each other and below the neck of the wearer on the back of the garment over the shoulders and down the front of the garment in parallel, thus forming a plurality of central panels 40, 42 of different widths Wa, Wb (see FIGS. 11 and 12). This provides further flexibility when the system is converted to the container mode, as the operator-wearer can select which first closure means to use, thereby determining the volume of the system when in the container mode.

The operator may alternatively elect to close the waist aperture, such that the body of the system forms a container.

As the waist aperture is typically larger than the neck aperture in a garment-shaped system, the system may be inverted so that the waist aperture is at the top of the system (see FIG. 4) for maximum convenience of the user. In this mode, the neck aperture is closed, as previously described, and the resulting container is inverted, such that the closed neck aperture forms the base of the container and the waist aperture faces upwards.

The transformation from garment to container mode and vice-versa is achieved by the closure or opening of the neck or waist aperture as described above.

A second closure means 50, preferably located at the waist may use the same mechanism, e.g. a zip, as the neck closure means. Alternatively, the waist and neck apertures may be closed by different mechanisms.

The mechanism adopted to close the second aperture may be, but is not limited to, a roll top closure, a drawstring closure, or a slide fastener closure, as shown in FIGS. 5-8. In one embodiment of the invention the second closure means is a roll top closure, wherein the flat waistband 52 of the empty garment is rolled over in the direction of the neck in the direction of the arrow D and two side attachment means 3*a*, 3*b* on the outer surface of the garment are pulled together and coupled together at a coupling point F to ensure that the rolled up waist does not unroll. The advantage of a roll top closure at the waist aperture, especially when the garment is inverted, is that access to the interior of the container via the waist aperture is easy and quick. Detachment/attachment of the side attachment means 3*a*, 3*b*, as well as rolling/unrolling of the waistband 52, is accomplished rapidly, thereby ensuring maximum convenience for the user.

According to this invention the sleeves 6 of the system perform a dual function. In the garment mode 22 they serve as sleeves, whereas in the container mode 24 the same sleeves serve as load-bearing straps.

In an embodiment of the invention one sleeve is fitted with a primary attachment means 5*a* which may be attached to a secondary attachment means 5*b* at a first location which is either on the other sleeve of the garment or on some other part of the garment (see FIG. 1), thereby forming a strap consisting respectively of two sleeves attached to each other or of a single sleeve attached to the another part of the system.

The secondary attachment means 5*b* may also be on the same sleeve as the primary attachment means 5*a*, such that a loop is formed within a single sleeve of the garment: in the container mode the closed loop formed in the sleeve is attached to the container via the proximal end of the sleeve.

As described previously the sleeve ends are fitted with attachment means 5*a*, 5*b* which may be attached to each other or to further attachment means at points on the body of the system.

FIG. 1 also illustrates an embodiment which further comprises a further primary attachment means at the end of the second sleeve and a further secondary attachments means located on the body at a location different from the first secondary means: each sleeve comprises a primary attachment means 5*a*, 5*b*, each of which may be attached to a corresponding secondary attachment means 5*b*, 5*a*.

Figure 9:
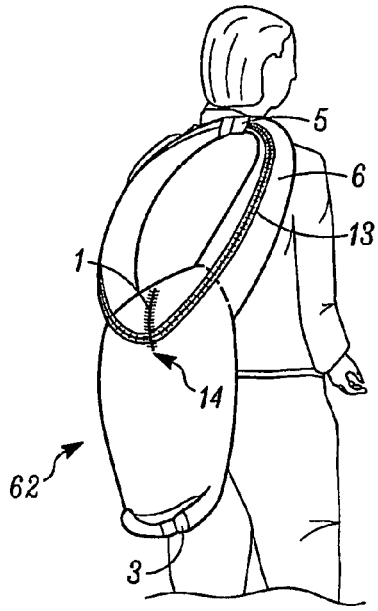
FIG. 9 is a rear view after the system as large 1 strap container configuration.
Figure 10:
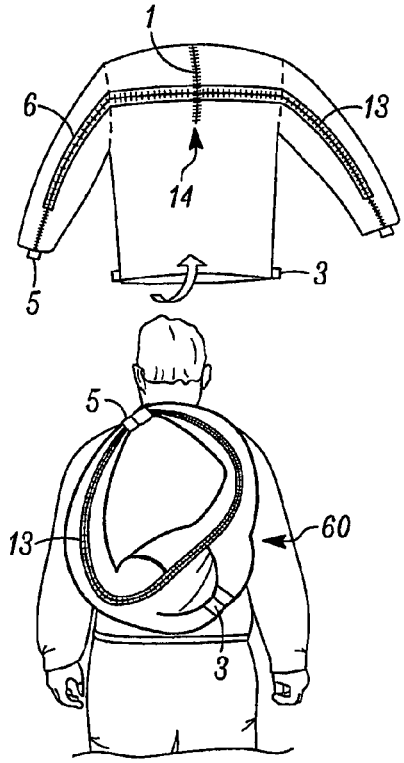
FIG. 10 is a rear view after the system as small 1 strap container configuration.

As will be appreciated from the foregoing, the two sleeves 6 may be converted into one or two straps. Whether one or two straps are created, the resultant strap(s) is (are) joined to the body at both ends. In the container mode, in which one or both of the waist or neck apertures are closed, so that the body becomes a container, the strap forms a load-bearing means for carrying the container. Thus, the container may form a rucksack (with two carrying straps), as in FIGS. 5 and 6, or a shoulder bag or hip bag (with a single strap), as illustrated in FIGS. 9 and 10.

Figure 7:
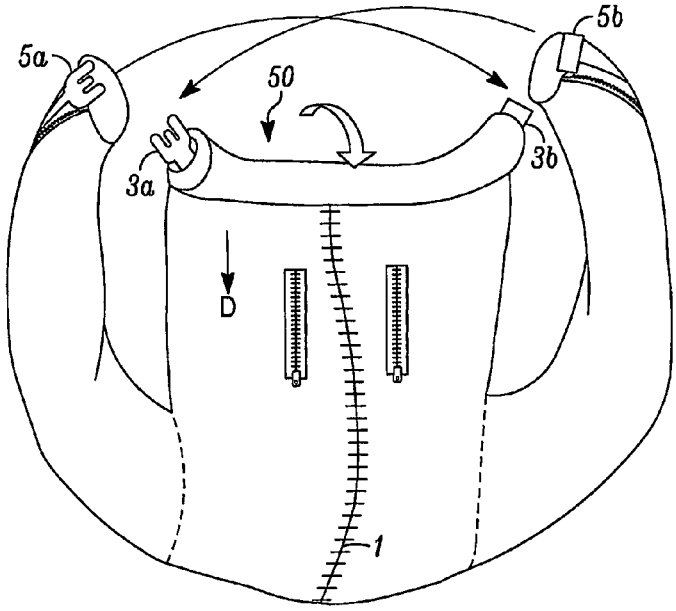
FIG. 7 is a front view of the system in container configuration without fasteners for the sleeves at the main body of the system before attachment of the carrying straps to the roll top closure fasteners.
Figure 8:
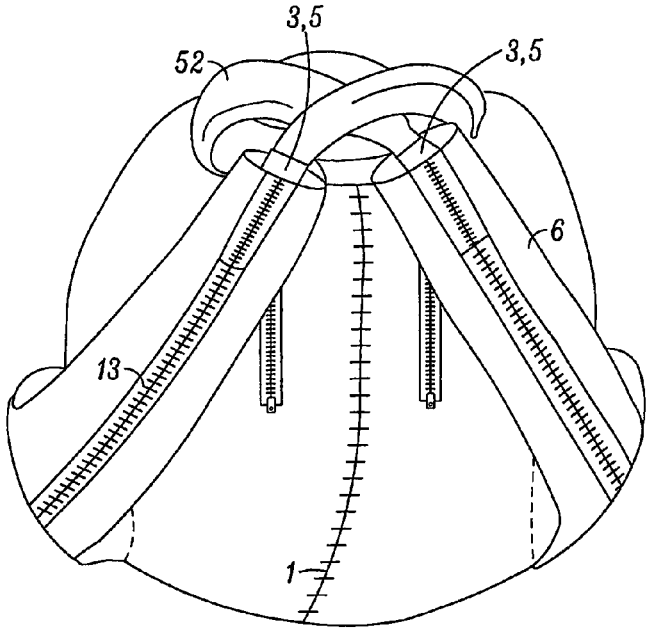
FIG. 8 is a front view of the system in container configuration without fasteners for the sleeves at the main body of the system after attachment of the carrying straps to the roll top closure fasteners.

As an alternative with the two-strap configuration described above the sleeve straps may be crossed over as in FIG. 8. In this configuration the attachment means 5*a*, 5*b* at the front of the body of the system are not required: the attachment means at the sleeve ends 5*a*/5*b* are cross-over attached to the opposite side attachment means 3*a*/3*b* at the ends of the waist aperture, as shown in FIGS. 7 and 8. For this the attachment means have to be fitted to the system in such a way that the fastener at the left/right sleeve end 5*a*, 5*b* can be attached to the right/left fastener of the roll-top closure 3*b*, 3*a* respectively to achieve the crossover arrangement, and thereby a centring, of the straps at the top.

A further advantage of the roll top closure is that it provides a means for adjusting the container volume. Converted to container mode, the size of the container can be adjusted by rolling the top as far down as required. Thus, a very small bag 60, or a very big bag 62 can be created as shown in FIGS. 9 and 10, irrespective of any inversion.

To give the system in container configuration more stability and durability, a strip of reinforcing material 13, such as textile webbing, is optionally incorporated into the design and extends from the attachments at the strap ends (sleeve ends) along the straps/sleeves up to the shoulders of the body of the system, as shown for example in FIGS. 2, 3, 5, 8. In a further embodiment a plurality of such reinforcing strips are included in both the sleeve/straps and in the body of the system. In the straps the reinforcing strips are arranged to maximise load distribution born by the straps e.g. by incorporating a fan-like arrangement of strips originating at the sleeve end attachment means and diverging radially therefrom toward the shoulder of the body of the system (see FIG. 12).

A short slide fastener means 7 is optionally incorporated at the sleeve ends, see insert in FIG. 2. This serves the following purposes: to store the click-clip attachment means 5, to reduce the width of the top end of the straps in container mode and, secondly, to close the sleeve ends in garment mode to give better protection and insulation.

Figure 4:
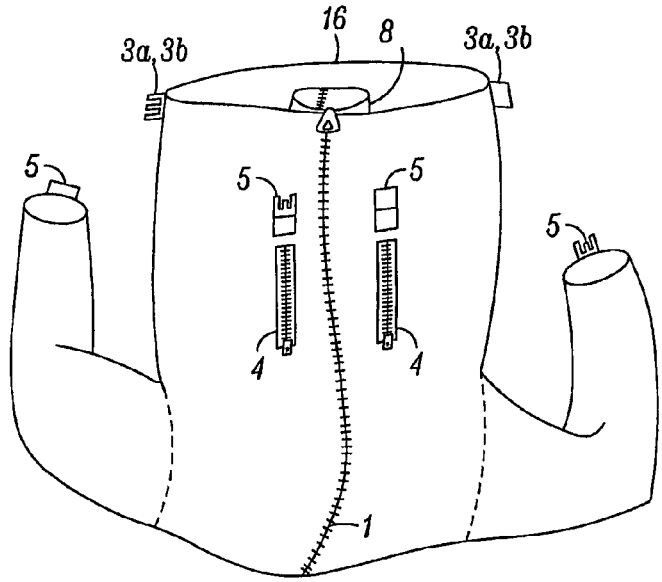
FIG. 4 is a front view of the system during transformation from garment to container after inversion.
Figure 5:
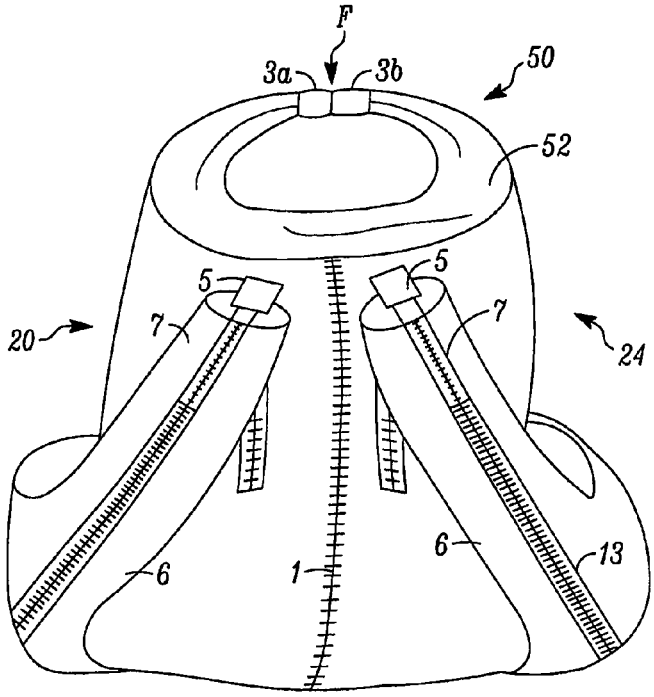
FIG. 5 is a front view after the system in 2-strap container configuration with roll top closure of the waist aperture.
Figure 6:
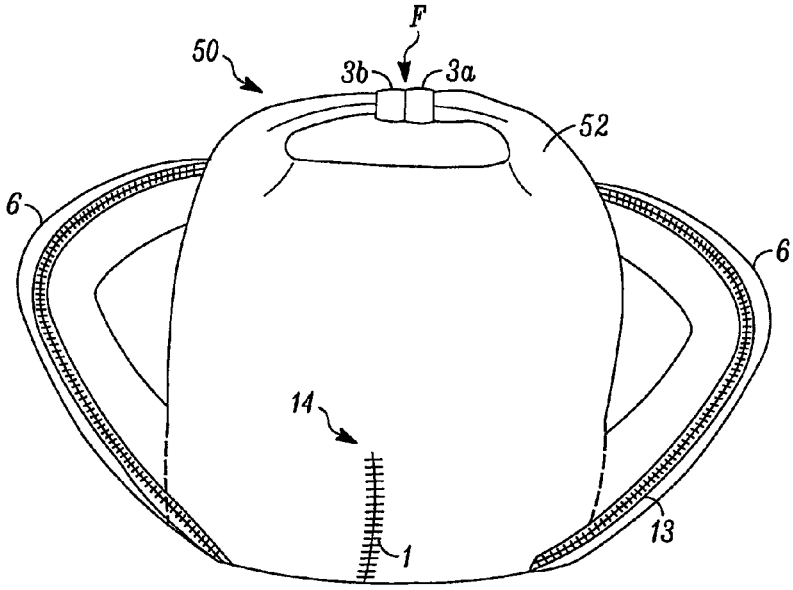
FIG. 6 is a rear view after the system in 2-strap container configuration with roll top closure.

The system has a number of internal pockets 4 which can be accessed from the outside of the system in garment mode and also after it has been transformed into a container, see FIGS. 1 and 4.

The system may also include slide fasteners 11 at either, or only one, side below the sleeves, as shown in FIG. 3. These fasteners have a dual function. In the garment configuration these slide fasteners can be opened to create air venting slots, which is desirable when using this system while doing exercise as for example hiking or cycling. The second function, according to this invention, is to use these fasteners as openings to a larger storage area between outer shell and lining of the system. The purpose of this large storage pocket is to allow the transport of mid-size objects, such as books or a towel, which were carried in the container even after transformation of the system to a garment. In order to provide this large pocket and allow ventilation, the inner lining should be made of material that allows free air flow, such as for example a gauze-like fabric.

The system may also comprise tightening means, such as straps, to serve as belts in garment mode and to restrict movement of the content in container mode.

The description and explanation provide background information pertaining to the technical field of the present invention and are intended to facilitate the understanding of the present invention. It will, however, be appreciated by those skilled in the art that variations and alterations are possible within the general scope of the invention which is defined in the appended claims.

The invention claimed is:

1. A system, for use in two different modes, having the form of an upper body garment, said system comprising:

a body for wearing, in a garment mode, on a torso of a wearer, said body having a central axis;

apertures corresponding to a waist and a neck of said wearer;

two sleeves;

a central opening extending from the neck to a point below the neck on the front of the body wherein said central opening comprises a first fastening means for closing said central opening; and, at least two elongate interlocking fastening elements configured to fasten along a length of said fastening elements, wherein, in a garment mode, when the fastening elements are open, the fastening elements extend from a first common point below the neck on a back of the body, over shoulders of the body either side of the neck aperture and down the front of the body on either side of the central opening and spaced from said fastening elements thereby forming at least one central panel between the edge of the central opening and the fastening element in each portion of the front of the body, and in a container mode, when the fastening elements are closed, the fastening elements interlock continuously from the first common point to a second common point located below the neck on the front of the body, thereby closing the neck aperture and the central panel is stored within the body of the system.

2. A system as claimed in claim 1 wherein, said second common point is located at the waist, thereby closing the neck aperture.

3. A system as claimed in claim 1 wherein the system consists of a jacket with said central opening extending from the neck to the waist on the front of the body, wherein said body is thereby divided into two portions.

4. A system as claimed in claim 1 wherein the fastening elements when closed extend along the central axis of the front of the garment.

5. A system as in claim 1 in which, wherein fastening elements, when open, extend parallel with the central axis.

6. A system as in claim 1 wherein the fastening elements, when open, extend along a line non-parallel with the central axis.

7. A system as claimed in claim 1 wherein said fastening elements include multiple fastening elements positioned at different distances from the central opening hereby forming central panels of different widths wherein, when two of the multiple fastening elements are closed, the body of the jacket comprises different volumes.

8. A system as claimed in claim 1 wherein the at least two fastening elements are selected from the group consisting of: a zip fastener comprising two interlocking elongate zip fastening elements; a slide fastening fastener comprising two interlocking elongate slide fastening elements; a press stud fastener comprising two rows of press studs elements, one row comprising female parts and the other row comprising male parts for interlocking with the female parts; and a hook and loop fastener comprising two interlocking elongate strips of hook and loop fasteners.

9. A system as claimed in claim 1 wherein said first fastening means include a zip fastener comprising two interlocking elongate zip fastening elements.

10. A system as claimed in claim 1 further comprising at least one closure means for closing a second aperture in said container mode.

11. A system as claimed in claim 10, wherein the at least one closure means selected from the group consisting of: a draw string fastener; a roll top fastener; a zip fastener; a hook and loop fastener; a slide fastener; and a stud fastener.

12. A system as claimed in claim 1 further comprising a primary attachment on a first sleeve and a secondary attachment distant from the primary attachment, wherein the primary attachment is attached, in the container mode, to the secondary attachment, thereby converting the first sleeve into a strap forming a loop.

13. A system as claimed in claims 12 wherein the primary attachment is located at the end of the first sleeve.

14. A system as claimed in claim 12 wherein the secondary attachment is located at the end of the second sleeve, wherein the strap is formed by joining the two sleeves together.

15. A system as claimed in claim 12 wherein the secondary attachment is located on the body at a first location.

16. A system as claimed in claim 12 further comprising a further primary attachment at the end of the second sleeve and a further secondary attachments is located at a second location, wherein a second strap is formed by attaching the further primary attachment to the further secondary attachment, thereby converting the second sleeve into a strap forming a loop.

17. A system as claimed in claim 12 wherein, in the container mode, at least the waist aperture is closed.

18. A system as claimed in claim 12 wherein, in the container mode, at least the neck aperture is closed and the system is inverted.

19. A system as claimed in claim 12 further comprising reinforcing which is either attached to or integrated into the fabric of the sleeve and extending from the attachment at the sleeve ends along the sleeves to the body.

20. A system as in claim 19 where the reinforcing is a reinforcing webbing extending in a fan away from the attachment means at the sleeve ends.

* * * * *